US005567222A

United States Patent [19]

Takahashi et al.

[11] Patent Number: 5,567,222

[45] Date of Patent: Oct. 22, 1996

[54] METHOD OF CONTROLLING SLAG COATING OF A STEEL CONVERTER

[75] Inventors: Katsunori Takahashi; Eizo Maeda; Hajime Suzuki; Sumio Yamada; Taichi Nakazawa; Yasuo Imaiida, all of Chiba, Japan

[73] Assignee: Kawasaki Steel Corporation, Japan

[21] Appl. No.: 408,066

[22] Filed: Mar. 21, 1995

[30] Foreign Application Priority Data

Mar. 24, 1994 [JP] Japan ..... 6-054138
Jun. 17, 1994 [JP] Japan ..... 6-135967

[51] Int. Cl.[6] ..... C21C 5/54

[52] U.S. Cl. ..... 75/376; 75/382; 75/386; 75/560; 75/570

[58] Field of Search ..... 75/376, 382, 386, 75/560, 570

[56] References Cited

U.S. PATENT DOCUMENTS 5,286,277 2/1994 Aizalulov et al. ..... 75/523

FOREIGN PATENT DOCUMENTS 3010012 1/1991 Japan ..... 75/382

*Primary Examiner*—Melvyn Andrews
*Attorney, Agent, or Firm*—Austin R. Miller

[57] ABSTRACT

A method of controlling slag coating in a steel converter in which slag is left in the converter after tapping, and a slag solidifying agent is added to the slag to form a coated slag which is used to coat the bottom and/or side wall surface of the converter. The method is performed by a) examining the composition of the slag at the tapping time;

b) determining, based on the examined slag and through an equilibrium calculation using thermodynamic data, the amount of solidifying agent per unit weight of the slag necessary for maintaining the liquid volume fraction of the coated slag to a value not greater than about 40% at the planned tapping temperature of the next charge of steel;

c) determining the amount of charge of the solidifying agent based on the calculated required amount of the solidifying agent and the amount of the slag remaining in the converter; and d) adding the calculated charge of the solidifying agent to the slag after tapping, to form a coated slag.

8 Claims, 3 Drawing Sheets

METHOD OF CONTROLLING SLAG COATING OF A STEEL CONVERTER

BACKGROUND OF THE INVENTION

1. Field of the Invention

The present invention relates to a method of controlling slag coating of a steel converter for attaining improved refractory life. More particularly, the present invention is concerned with a coating control method capable of preventing coating slag from flowing out of the converter during blowing.

2. Description of the Related Art

In recent years, a trend toward increasing steel converter capacities has arisen. At the same time, steel converters have been required to operate under increasingly severe conditions. Concurrently, a demand for improved production efficiency and reduced production cost of steel has increased. Consequently, prolonging converter furnace life has become a strong priority. Various methods have been proposed to lengthen converter service life.

One such technique involves coating converter with slag to extend refractories life. This technique may be further divided into two general methods.

One such method involves elevating CaO and MgO content during blowing to chemically suppress melting of the refractories.

The other method, which is known as "slag coating," makes use of residual slag that remains after blowing. More specifically, a slag solidifying agent, brick chips and other ingredients are mixed with the residual slag to form a "coated slag." After a blowing, this coated slag is welded onto the surfaces of refractories bricks on the side and/or bottom walls of the converter by spraying or by tilting the converter. The welded layer of the coated slag will be referred to as the "coating layer."

In the first-mentioned method, melting of the refractories is suppressed by a chemical effect which inhibits dissolution of components of the refractories. Conversely, the second-mentioned method reduces thermal load imposed on the refractories so as to suppress thermal spalling. In extending converter refractory life, it is important to prevent rapid damage and wear of the bricks through effective suppression of thermal spalling.

Various methods for suppressing thermal spalling have been proposed. Japanese Patent Laid-Open No. 61-157610 proposes a method in which the inner surfaces of a converter are coated with coated slag which is formed by adding a slag solidifying agent into residual slag, while means are provided for forcibly cooling the coating layer. When the blowing for the next charge of steel is conducted for a long time at high temperature, however, the slag itself is heated to a high temperature such that the coating layer cannot be retained due to melting and flowing down of the slag.

Japanese Patent Laid-Open No. 61-56223 discloses a method in which slag is left in the converter after each steel discharge and is blown by a gas from an upper blowing lance such that the slag is scattered—deposited on the inner surfaces of the converter. When the slag viscosity is low enough to permit scattering, the coating layer cannot be retained due to melting and flowing down of the slag. On the contrary, when the slag viscosity is high, the slag does not fly freely and the converter inner surfaces are not adequately coated.

Japanese Patent Publication No. 62-24490 discloses a method which utilizes a converter that does not employ dephosphorization and desulfurization. The slag composition at the end of the blowing is controlled to meet the conditions of $CaO/SiO_2=1.6$ to 2.5, $MgO/CaO>0.25$ and $SiO_2/(CaO+MgO+SiO_2)\geqq 0.25$. The deposition of the slag is believed to be enhanced by the condition wherein $SiO_2/(CaO+MgO+SiO_2)\geqq 0.25$. Unfortunately, this method does not allow the coating layer to be retained after the end of the subsequent blowing cycle.

Japanese patent Publication No. 2-2992 discloses a method in which chromium ore is charged before oxygen blowing in a high-chromium melting converter to maintain a slag composition containing 30 to 50% $Cr_2O_3$. This method seeks to control slag composition during blowing. Increasing the fluidity of the slag impairs coating but improves slag formation efficiency. Conversely, when slag fluidity is reduced to improve coating characteristics, slag formation efficiency is undesirably lowered.

Japanese Patent Publication No. 62-13407 discloses a method in which a powdered refractories, mainly composed of MgO, is blown by flame gunning onto slag remaining in a converter so as to coat the inner surfaces of the converter with the mixture of the slag and the powdered refractories. This method requires an impractically long time for the blowing and, hence, cannot be used where the tapping interval is short.

Japanese Patent Publication No. 61-59364 discloses a method in which a basic refractories in the form of bulk or aggregates of 100 to 200 mm is charged into the slag remaining in the converter so that the slag is solidified by being kept stationary for 15 minutes. This method is suitable for repairing portions of the converter damaged by spalling, but cannot be used for repairing of the trunnion side of the converter.

Japanese Patent Laid-Open No. 2-111810 discloses a method in which, in order to prevent the slag floating on the steel melt surface from being discharged together with the steel, the solid volume fraction of the slag is maintained at 30% or greater. This method prevents quality deterioration of the discharged steel due to presence of slag. However, the tapping operation tends to be impeded when the fluidity of the slag is excessively decreased. This method, therefore, cannot be applied to slag coating methods that require the coating to sustain direct contact with the flowing steel melt during a long blowing period.

SUMMARY OF THE INVENTION

In view of the foregoing, an object of the invention is to provide a slag coating control method for coating the bottom and/or side wall inner surface of a converter. Suppression of the flowing out of the coating layer during blowing is improved regardless of any change in the slag composition, such that the protective effect of coated slag is maintained through the tapping time, thereby extending the life of refractories used in the converter.

We have found a close correlation between the critical temperature of slag fluidity and the liquid volume fraction of the slag. The term "liquid volume fraction" is used here to mean the volumetric ratio (percentage) of the liquid phase maintained in an equilibrium state after precipitation of the solid phase at each temperature for each composition of the slag.

The invention provides a method of controlling slag coating in a converter in which a slag solidifying agent is added to the slag left in the converter after tapping to form a coated slag which is used to coat the bottom and/or side wall inner surface of the converter. The method involves examining the composition of the slag at the tapping time to determine, based on the examined slag and through an equilibrium calculation using thermodynamic data, the amount of the solidifying agent per unit weight of slag necessary for maintaining the liquid volume fraction of the coated slag at a value not greater than about 40% at the planned tapping temperature of the next charge of steel. The method further requires determining the amount of charge of the solidifying agent based on the calculated required amount of the solidifying agent and the amount of the slag remaining in the converter.

When the weight content of $Al_2O_3$ in the slag is about 2% or greater, dolomite is used as the solidifying agent in an amount determined in accordance with the following equation, per unit weight of the slag:

$$W \geqq [K_1+K_2\times(\%\ Al_2O_3)-K_3\times(\%\ Al_2O_3)^2]/(100-I) \quad (1)$$

where,

W: amount of charge of dolomite (unit weight)

I: ignition loss of the dolomite used (%)

% $Al_2O_3$: weight percentage of $Al_2O_3$ $K_1$, $K_2$, $K_3$: constants

These and other objects, features and advantages of the invention will become clear from the following description and accompanying drawings.

DETAILED DESCRIPTION OF THE INVENTION

Heretofore it had not been known why coated slag is retained through the end of blowing in some cases but is separated and molten from the converter inner surface in other cases. Nor was there any known relationship between slag temperature and apparent slag viscosity (which represents an index of fluidity) for both synthetic slag and converter slag.

We have surprisingly discovered that the viscosity of the slag gradually increases in accordance with a reduction of temperature. Further, a drastic increase in viscosity is observed when the temperature is lowered below a certain temperature depending on the type of slag. This temperature has been determined to be critical, and will be referred to as the "critical temperature.".

Table 1 (which follows) shows slag compositions which we have examined together with their critical temperatures and the liquid volume fractions at the critical temperatures. Slag samples A to C are synthetic slags with varying basicity ($CaO/SiO_2$) and MgO content, while slag samples D to F are converter slags generated in a converter.

Figure 1:
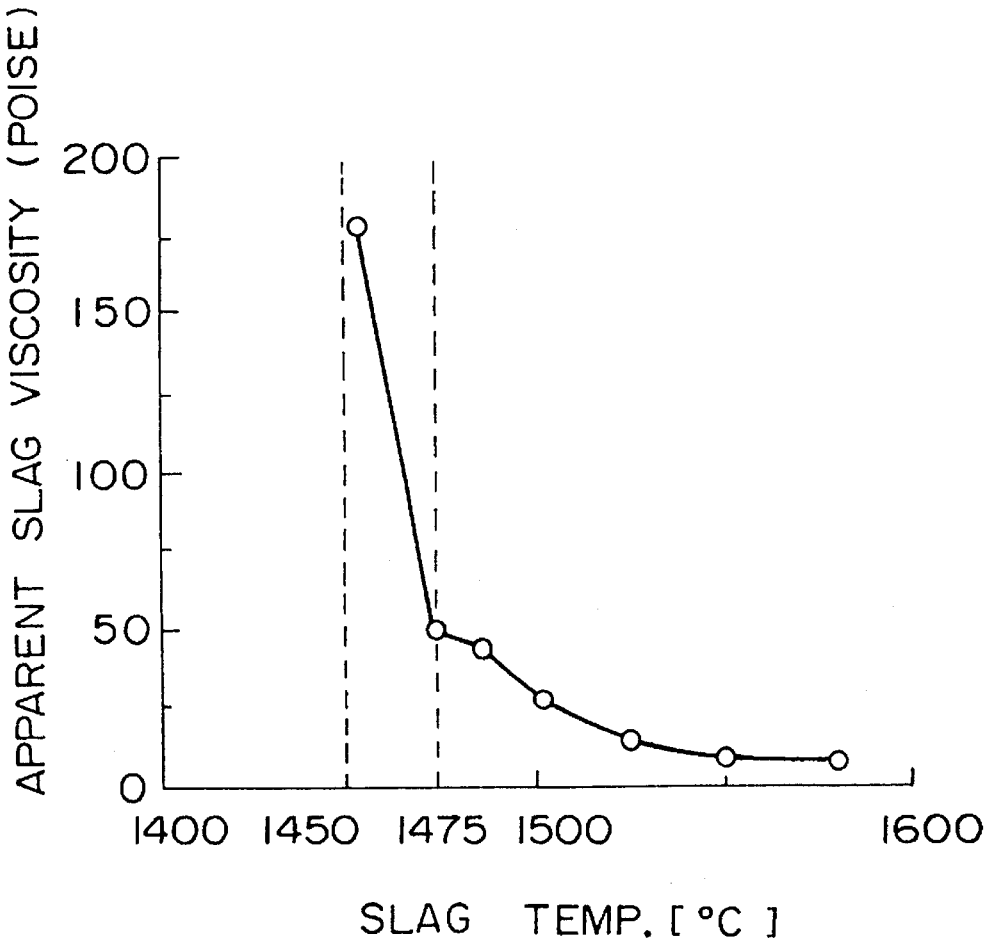
FIG. 1 is a graph showing a typical relationship between the apparent viscosity of slag and slag temperature.

Results of measurement of apparent viscosity of the slag sample A as an index of fluidity is shown in FIG. 1. In this case, the critical temperature for slag fluidity exists between about 1450° C. and 1475° C.

It was discovered that a close relationship exists between the apparent viscosity and the liquid volume fraction of the slag, irrespective of the slag composition.

TABLE 1

| | Slag | | | | | |
|---|---|---|---|---|---|---|
| Composition | A | B | C | D | E | F |
| CaO | 75.0 | 78.13 | 75.0 | 58.83 | 60.41 | 58.74 |
| $SiO_2$ | 18.75 | 15.63 | 18.75 | 7.07 | 4.74 | 5.51 |
| MgO | 6.25 | 12.5 | 9.38 | 16.59 | 24.25 | 21.02 |
| FeO | — | — | — | 8.84 | 5.38 | 6.54 |
| $Al_2O_3$ | 10.0 | 10.0 | 9.0 | 2.17 | 1.38 | 3.45 |
| MnO | — | — | — | 4.49 | 2.65 | 3.28 |
| $P_2O_5$ | — | — | — | 2.01 | 1.19 | 1.47 |
| Critical Temperature (°C.) | 1,450–1,470 | 1,480–1,500 | 1,525 –1,500 | 1,400–1,425 | 1,575–1,600 | 1,500–1,525 |
| Liquid Volume Fraction (%) | 28.5–29.5 | 28.5–30.0 | 30.5–32.0 | 32.0–33.5 | 32.5–34.0 | 30.5–32.0 |

Table 1 reveals that different slags exhibit different critical temperatures but that the volumetric fractions remain generally about 30%.

This phenomenon is considered to be due to a reduction in the slag temperature causing gradually precipitated solid phase to be suspended in the liquid phase. A progressive decrease in the liquid volume fraction consequently occurs, resulting in gradually increased viscosity. When the critical temperature is reached the solid phase suspended in the liquid phase contacts directly causing a rapid rise in viscosity.

When the temperature of the coating layer exceeds the critical temperature in the blowing operation of a converter, the apparent viscosity of the coated slag decreases and the coated slag flows out during the blowing, thus wiping out the coating layer. Conversely, when the slag composition is controlled such that the blowing temperature does not exceed the critical temperature of the slag, the slag maintains high apparent viscosity whereby the coated slag does not flow out even during the blowing.

It has been discovered that the slag coating layer can be retained without flowing out so as to continue to serve as the protective layer, even when the tapping temperature is reached and even if the liquid volume fraction of the coated slag inside the converter exceeds about 30%, provided that the liquid volume fraction does not exceed about 40%. This effect is considered to be attributable to the fact that, even though the critical temperature is exceeded in the surface region of the coating layer, the temperature of the slag portion adjacent to the refractories behind or under the slag remains low such that a substantial portion of the slag does not flow out even after the end of the blowing. However, if the converter operation is continued while the liquid volume fraction of the slag is above about 40 % the coating layer will undesirably flow down during the blowing. In order to achieve the remarkable protection of the refractories, it is preferred that the liquid volume fraction of the slag be maintained at about 30% or less.

In the case of the slag generated in the converter, solid phase density and liquid phase density are almost equal to each other. It is therefore possible to achieve control based on weight percentages in lieu of liquid volume fractions, such that the weight ratio is maintained to be about 40% or less.

Control of the liquid volume fraction may be accomplished as follows. An examination is made as to the composition of the object slag at the tapping time. Then, a determination is made as to the ratio at which the solidifying agent is to be charged in order to control the liquid volume fraction at the tapping temperature to a level below about 40%, thus determining the amount of the solidifying agent to be charged.

The liquid volume fraction of the slag as the control target can be determined by an equilibrium computation based on thermodynamic data such as standard free energy, free energy of generation and so forth. The liquid volume fraction also can be determined from an analysis of the microstructure of the slag performed when the slag is rapidly cooled from a predetermined elevated temperature.

The thermodynamics calculation may be conducted by using a commercially available thermodynamics computing software, such as a software sold in the name of Thermo-Cale, MALT2, ChemSage, and so forth. When data including temperature and slag composition is input to a personal computer which is loaded with such a software, chemical compositions and amounts of substances such as solid phases and liquid phases existing in equilibrium state at such temperature are automatically computed. It is possible to know the liquid phase weight ratio from which liquid volume fraction is determined using the known values of specific weights.

The liquid volume fraction also can be determined through microstructure analysis of the slag obtained through solidification by rapid cooling. According to this method, slag is molten at a predetermined temperature and then cooled rapidly. Water quenching is an easy method to carry out this treatment in a laboratory scale. After melting the slag in a crucible, the molten slag is thrown into water so as to be rapidly cooled. When this treatment is conducted in actual furnace, a rod of a diameter of 50 mm or so, made of copper which has a large thermal capacity, is dipped in the molten slag and is withdrawn without delay, so that rapidly cooled slag can be obtained as a deposit on the copper rod. The rapidly cooled slag is ground for observation of the microstructure through a microscope. In the case of a rapidly cooled slag from a converter, the portion which has existed in the form of liquid phase is glassified as a result of the rapid cooling, so as to provide a structure in which solid phases are dispersed in the glass. It is possible to determine the solid volume fraction in the rapidly cooled slag by using stereological technique. The liquid volume fraction is then found from the thus determined solid volume fraction.

It is possible to form, by using the described techniques, a table of liquid volume fraction values using the slab composition and the tapping temperature as parameters. Using such a table, it is possible to easily locate the liquid volume fraction during operation of the converter, based on the slab composition and the tapping temperature of the next charge.

The slag composition at the tapping time and the steel temperature at the tapping time are determined as follows:

(a) Values for each charge are calculated from quantities of sub-materials for each charge, slag composition at the end of blowing predicted from the rate of blowing of oxygen, or slag composition measured through sampling after the end of blowing.

(b) Values obtained with the object converter under ordinary conditions of blowing are calculated from average slag composition based on the past achievement of the converter, or slag composition according to the operation plan of the converter.

(c) Values obtained during blowing of the each type of steel are calculated from average slag composition obtained for each steel type blow in the converter.

(d) Average values obtained through current 50 to 100 charges are calculated from average slag composition over current 50 to 100 charges of the converter.

In this manner, these slag compositions can be used as the basis for control.

Charging of the solidifying agent may be effected immediately after tapping or after discharging part of the slag subsequent to tapping.

Dolomite such as green dolomite and light burnt dolomite can be used as the solidifying agent. Other agents such as magnesia clinker may also be used. It is also possible to measure the composition of slag discharged and reuse this slag.

Another object of the invention is to suppress the out-flow of coated slag in the converter during blowing to extend the life of the refractories in the converter, even when the $Al_2O_3$ wt % (expressed as "% $Al_2O_3$" hereinafter) in the slag is high.

In recent years, the use of scrapped cans as the cold iron resource or modification of slag has made it difficult to maintain a coating layer in a converter under ordinary blowing operation because the amount of $Al_2O_3$ in the slag has increased.

This is partly attributable to the large Al content in the scrapped cans. We have discovered, based on measurements of the temperature of the converter bottom, that the temperature around a tuyere tends to rise when the alumina content in the slag is high. When the alumina content of the slag is high, the coated slag can separate, thus reducing the thickness of the coating layer.

An analysis of the relationship between the slag fluidity and the % $Al_2O_3$ in the slag, and the relationship between the critical temperature for the slag fluidity and liquid volume fraction of the slag observed when the alumina content in the slag is high was undertaken. It was discovered that the optimum amount of charging of the solidifying agent does not depend greatly on the % MgO and the ratio $CaO/SiO_2$, and that a good coating layer can be obtained by using dolomite as the solidifying agent and controlling the amount of dolomite in relation to a change in weight % $Al_2O_3$ in the slag.

Figure 2:
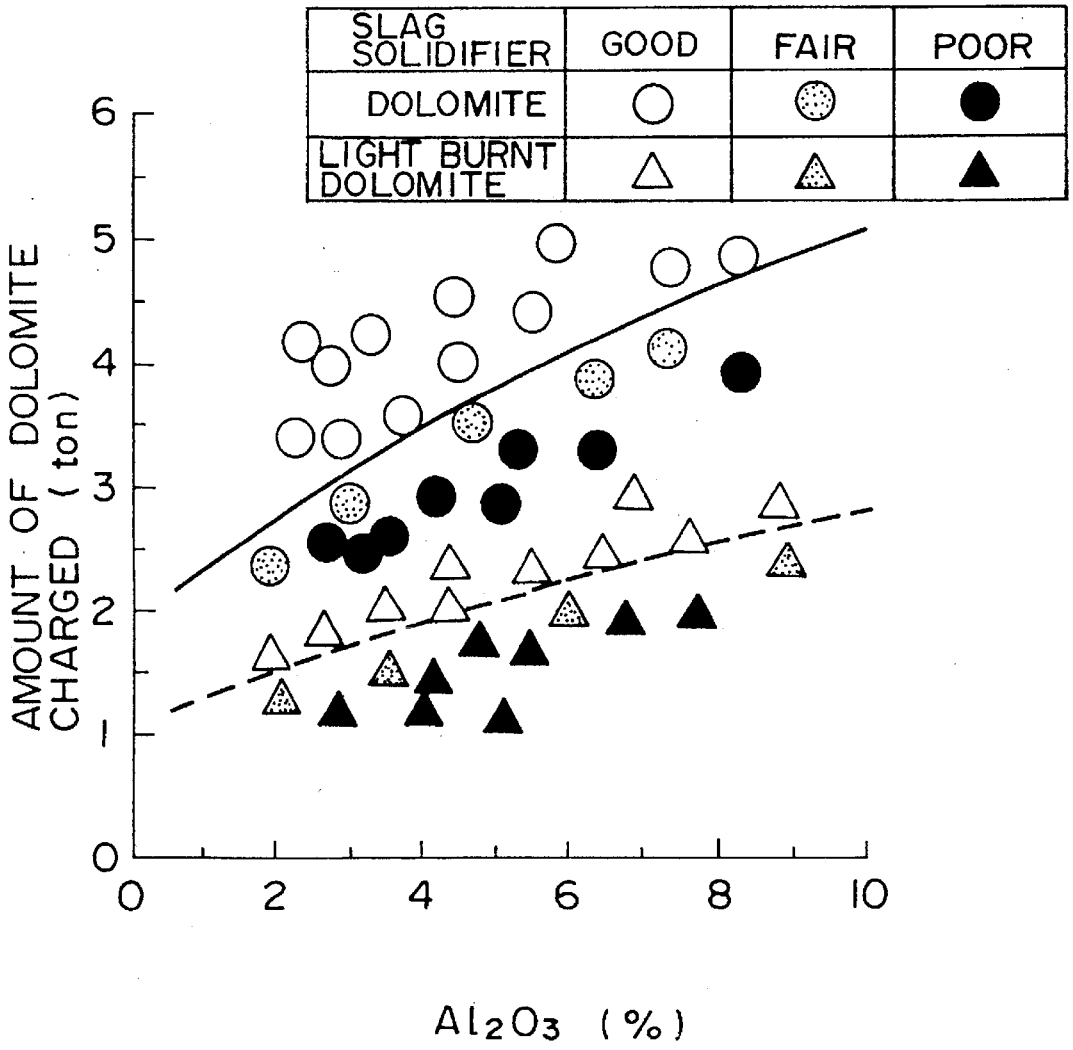
FIG. 2 is a graph showing a relationship between weight ratio of alumina and amount of dolomite charged.

FIG. 2 shows the relationship between the weight $Al_2O_3$ in the slag and the state of residence of the coated slag as observed in an actual converter when 3 tons of slag were left in the converter prior to the charging of the solidifying agent. The state of residence of the coating layer was observed by checking whether the coating layer, which was formed prior to the charging of the molten iron, remains deposited on the converter bottom when tapping is conducted after completion of one blowing cycle. The optimum charging amount of the solidifying agent for forming good coating varies according to the weight % $Al_2O_3$ in the slag, regardless whether the solidifying agent is green dolomite or light burnt dolomite.

The ignition losses of the green dolomite and lightly burnt dolomite were 46% and 3% by weight, respectively. The difference between the optimum amount of green dolomite charging and the amount of the light burnt dolomite charging for attaining good residual deposition of the coating layer can well conform with the difference in the ignition loss between these two types of solidifying agents.

The optimum amount (W) of dolomite charging per unit weight of slag having wt. % $Al_2O_3$ of about 2% or higher can be determined in accordance with the following equation:

$$W \geqq [K_1+K_2\times(\%\ Al_2O_3)-K_3\times(\%\ Al_2O_3)^2]/(100-I) \quad (1)$$

where,

W means amount of charge of dolomite (unit weight)

I means ignition loss of the dolomite used (%)

% $Al_2O_3$ means weight percentage of $Al_2O_3$, and $K_1$, $K_2$, $K_3$ are constants where $K_1=35$, $K_2=7.5$ and $K_3=0.2$ The control method for the dolomite charge is as follows. The composition of the object slag is determined at the tapping time. Then, the wt. % $Al_2O_3$ of the slag composition, when wt. % $Al_2O_3$ is about 2% or greater, is substituted in the above-mentioned equation, thus determining the amount W of dolomite to be charged.

When the above-mentioned amount W of dolomite is charged, the coated slag can maintain its protective effect without substantial out-flow. However, if there is a shortage in the amount of dolomite charge, $Al_2O_3$ concentration in the coated slag is increased so as to enhance fluidity, thus allowing the coated slag to flow out.

The charging of dolomite as the solidifying agent is done immediately following tapping or after a partial discharge of the slag subsequent to tapping. Ordinary types of dolomite such as green dolomite and light burnt dolomite can be used.

It is not necessary that molten pig iron constitute the entire iron resource. Alternatively, it is possible to use scraps containing Al and/or $Al_2O_3$, such as scrapped can or slag-containing steel generated from a steel making process following the converter operation. There is no restriction in the amount of scraps used, although this amount is preferably about 15% by weight or less.

The critical temperature at which the apparent viscosity of slag drastically changes increases when the weight % $Al_2O_3$ in the slag increases. Thus, increases in the weight % $Al_2O_3$ in the slag increases the liquid volume fraction so as to enhance slag fluidity, allowing melting down and flowing of the coated slag.

It is possible to lower the liquid volume fraction of the slag down to about 40% or less by charging dolomite as a slag solidifying agent into the slag.

The invention is generally applicable to bottom-blowing converters as well as to bottom/top blowing compound converters.

The invention will now be described in terms of illustrative Examples which are not intended to limit the invention defined in the appended claims.

EXAMPLE 1

Slag coating in accordance with the invention was conducted on a 230-t pure oxygen bottom blowing converter. After a tapping, slag was partly discharged to leave 3 tons of slag in the converter. In the next charge of steel, the iron resource was wholly constituted by molten iron, so that the $Al_2O_3$ content was as small as 1.2 wt %. Tapping was conducted at a temperature between 1580° C. and 1650° C.

Throughout the object converter campaign, each charge was controlled such that the liquid volume fraction of the coated slag at the tapping temperature of the next charge did not exceed 40%. The administration was conducted by using the average slag composition obtained over several operations of the converter conducted in the past under similar operating conditions. Green dolomite was used as the solidifying agent. The amount of solidifying agent charge is determined, based on an equilibrium computation employing thermodynamic data, such that the liquid volume fraction of the coated slag at the expected tapping temperature does not exceed 40%. In this case, the amount of charge of the solidifying agent was determined to range between 2.5 tons and 3.5 tons.

Slag coating was conducted by using the above-mentioned solidifying agent, and the thickness of the remaining refractories bricks was measured after tapping. In general, wear and damage of the refractories is heaviest at the bottom of the converter, so that the thickness of the converter bottom brick was measured and used as an index for the evaluation of the damage suppressing effect produced by the invention. The amount of damage per charge was determined by measuring the change or reduction in the bottom brick thickness over several successive charges. The measured amount of damage was 0.45 mm per charge.

EXAMPLE 2

Slag coating in accordance with the present invention was conducted on a 230-t pure oxygen bottom blowing converter. After tapping, slag was partly discharged so as to leave 3 tons of slag inside the converter. The iron resource was composed of, on average, 95% of molten iron and 5% of scrap. The scrap contained $Al_2O_3$ formers such as scrapped can and steep deposit on a ladle, so that the $Al_2O_3$ content in the generated slag was as high as 3.0 to 8.7 wt %. The tapping temperature ranged between 1590° C. and 1650° C. An administration was executed such that the liquid volume fraction of the coated slag at the tapping temperature of the next charge did not exceed 40%. In this case, light burnt dolomite was used as the solidifying agent. In view of the high % $AlO_3$, the amount of the charge was determined by calculation to be 2 to 3 tons. Amount of damage was determined by measuring the change in the thickness of the remaining brick over several successive charges. The amount of damage thus determined was 0.47 mm/charge.

COMPARATIVE EXAMPLE 1

Slag coating was executed in the same way as Example 1 on a 230-t pure oxygen bottom blowing converter. After tapping, the slag was partly discharged so that 3 tons of Slag remained in the converter. The iron resource for the subsequent charge was wholly constituted by molten iron, so that $Al_2O_3$ content was as low as 1.2 wt %. The tapping temperature ranged between 1580° C. and 1650° C. Throughout the object converter campaign, in each charge of steel, the liquid volume fraction of the coated slag at the tapping temperature of the subsequent charge did not exceed 65%. However, no charge satisfied the requirement of the liquid volume fraction being 40% or less. In this case, green dolomite was used as the slag solidifying agent, but the amount of charge of this agent was as small as 1 to 2 tons.

The amount of damage as determined through measurement of thicknesses of the remaining refractories bricks over several charge cycles was 0.84 mm per charge.

COMPARATIVE EXAMPLE 2

Slag coating was conducted on a 230-t pure oxygen bottom blowing converter in the same way as Example 1. After tapping, slag was partly discharged so as to leave 3 tons of slag inside the converter. In this case, the iron resource consisted of, as an average, 95% of molten iron and 5% scrap. The scrap contained $Al_2O_3$ formers such as scrapped can and steep deposit on a ladle, so that the $Al_2O_3$ content in the generated slag was as high as 3.0 to 8.5 wt %. The tapping temperature ranged between 1590° C. and 1650° C. An administration was executed such that the liquid volume fraction of the coated slag at the tapping temperature of the subsequent charge did not exceed 40%. In this case, light burnt dolomite was used as the solidifying agent. The amount of dolomite charged was determined to be 0.5 t to 1 t which is much smaller than that required by the present invention, despite the high $Al_2O_3$ content, since in this case the control was done in a conventional manner. Amount of damage was determined by measuring the change in the thickness of the remaining brick over several successive charges. The amount of damage thus determined was 0.85 mm/charge.

Figure 3:
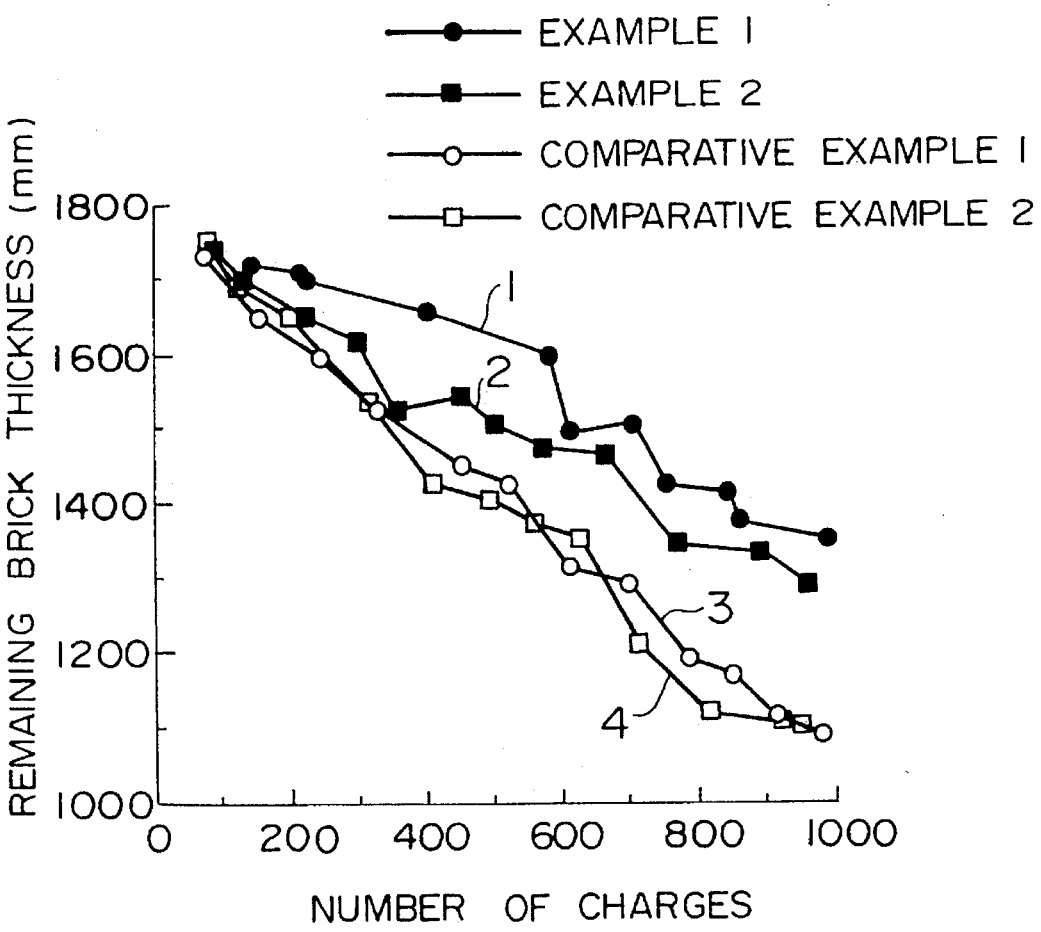
FIG. 3 is a graph showing a relationship between measured thickness of remaining brick and number of charges sustained.

FIG. 3 shows the change in the thickness of the remaining bottom refractories bricks in the Examples and Comparison Examples described above. Curves 1 and 2 show the thicknesses as observed in the Examples meeting the conditions of the invention, while curves 3 and 4 show Comparative Examples. From the comparison between the curves 1, 2 and curves 3, 4, it is seen that the thicknesses of the remaining bottom bricks are much greater, i.e., the amount of damage per charge is much smaller, than those in the Comparative Examples. This demonstrates that the invention greatly suppresses damage and wear of the refractories. State of residence of coated slags on the bottom surface and side surface of the converter was visually checked after tapping, in advance of the next charging of steel. The visual check of the converter bottom after operation in accordance with the invention showed that joints between bricks were completely hidden under the coated slag, thus proving residence and retention of the coating layer even after the end of tapping. In contrast, in the Comparative Examples, joints were clearly recognized between adjacent bricks, thus indicating that coated slag has been lost during the blowing, allowing the bricks to be directly exposed to the molten steel.

The superiority of the slag coating control method in accordance with the invention was thus demonstrated.

According to the present invention, the melt down or loss of the coated slag on the bottom and/or side surface of a converter is greatly suppressed so as to remarkably extend the life of the refractories in the converter, thus permitting an appreciable reduction in the cost of operating a converter.

Although this invention has been described with reference to specific forms of apparatus and method steps, equivalent steps may be substituted, the sequence of steps may be reversed, and certain steps may be used independently of others. Further, various other control steps may be included, all without departing from the spirit and scope of the invention defined in the appended claims.

What is claimed is:

1. In a method of controlling slag coating in a converter in which a liquid volume fraction of slag is retained in a converter after tapping in preparation for the introduction of a subsequent charge of steel into said converter at a tapping temperature, and wherein a slag solidifying agent is added to the retained slag to form a coated slag which is used to coat the inner surfaces of said converter, the steps comprising:

a) determining the composition of a slag at the time of tapping;

b) determining, based upon said composition of said slag at said time of tapping, and through equilibrium determination using thermodynamic data, the amount of said slag solidifying agent to be added per unit weight of said slag, which amount is required for maintaining said liquid volume fraction of said coated slag at a value up to but not greater than about 40% at said tapping temperature for said subsequent charge of steel;

c) determining the amount of charge of said slag solidifying agent based on the required amount of said slag solidifying agent and the amount of said slag remaining in said converter; and d) adding said determined amount of said slag solidifying agent to said slag after said tapping to form said coated slag.

2. A slag coating control method according to claim 1, wherein said value of said liquid volume fraction is up to but not greater than about 30%.

3. A slag coating control method according to claim 1, wherein said slag solidifying agent is selected from the group consisting of green dolomite, light burnt dolomite, magnesia clinker and slag previously discharged.

4. A slag coating control method according to claim 1, wherein the slag has a content of $Al_2O_3$ of about 2% or greater, and wherein dolomite is used as said slag solidifying agent, the amount of said dolomite being determined in accordance with the following equation, per unit weight of said slag:

$$W \geqq [K_1+K_2\times(\%\ Al_2O_3)-K_3\times(\%\ Al_2O_3)^2]/(100-I) \quad (1)$$

where,

W means the charge of dolomite (unit weight);

I means the ignition loss of the dolomite used (%);

% $Al_2O_3$ means the weight percentage of $Al_2O_3$, and wherein $K_1$, $K_2$, $K_3$ are the following constants:

$K_1=35$, $K_2=7.5$ and $K_3=0.2$.

5. A slag coating control method according to claim 1, further comprising conducting said method on a converter selected from the group consisting of a bottom blowing converter and a top and bottom blowing composite converter.

6. A slag coating control method according to claim 2, further comprising conducting said method on a converter selected from the group consisting of a bottom blowing converter and a top and bottom blowing composite converter.

7. A slag coating control method according to claim 3, further comprising conducting said method on a converter selected from the group consisting of a bottom blowing converter and a top and bottom blowing composite converter.

8. A slag coating control method according to claim 4, further comprising conducting said method on a converter selected from the group consisting of a bottom blowing converter and a top and bottom blowing composite converter.

* * * * *